US006351251B1

(12) United States Patent
Mitsui

(10) Patent No.: US 6,351,251 B1
(45) Date of Patent: Feb. 26, 2002

(54) HELICAL ANTENNA

(75) Inventor: Tsutomu Mitsui, Yokohama (JP)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/651,625

(22) Filed: Aug. 30, 2000

(30) Foreign Application Priority Data

Aug. 31, 1999 (JP) ..... 11-246433

(51) Int. Cl.[7] ..... H01Q 1/36
(52) U.S. Cl. ..... 343/895; 343/773; 343/846
(58) Field of Search ..... 343/702, 773, 343/785, 846, 848, 895

(56) References Cited

U.S. PATENT DOCUMENTS 5,038,152 A * 8/1991 Wong et al. ..... 343/756
5,346,300 A * 9/1994 Yamamoto et al. ..... 343/895
5,561,439 A * 10/1996 Moilanen ..... 343/846
6,181,295 B1 * 1/2001 Sharaiha et al. ..... 343/895
6,184,845 B1 * 2/2001 Leisten et al. ..... 343/895

* cited by examiner

*Primary Examiner*—Tan Ho
(74) *Attorney, Agent, or Firm*—Steve Cha; Klauber & Jackson

(57) ABSTRACT

The invention discloses a 4-line type helical antenna with a simple structure, which can obtain a uniform antenna gain even at a low elevation angle, has a radiation pattern that is not affected even when the antenna is mounted on the chassis of an automobile. The helical antenna comprises a circular cone having a metal surface interposed between an antenna body for transmitting and receiving radio waves to/from a satellite and a satellite terminal for transmitting and receiving the radio waves to/from the antenna body, wherein the circular cone reflects the radio waves of the antenna body. The antenna body has antenna conductors that are spirally formed thereon, and the circular cone is tapered at a predetermined angle so as to uniformly reflect the radio waves of the antenna body. The circular cone is fixed to one end of the antenna body in such way that the tapered angle of the circular cone should be uniformly allocated with respect to an axis of the antenna body.

17 Claims, 7 Drawing Sheets

FIG. 3 [PRIOR ART]

HELICAL ANTENNA

CLAIM OF PRIORITY

This application makes reference to and claims all benefits accruing under 35 U.S.C. Section 119 from an application entitled, "Helical Antenna", filed in the Japanese Patent Office on Aug. 31, 1999 and there duly assigned Serial No. 11-246433.

BACKGROUND OF THE INVENTION

1. Field of the Invention

The present invention relates generally to an antenna structure. More particularly, the present invention relates to a helical antenna.

2. Description of the Related Art

A Broadcasting Satellite (BS) antenna, which uses circularly polarized waves, is often used as a satellite telephone terrestrial base station (hereinafter, referred to as a satellite telephone). Such an antenna requires a uniform antenna gain over a wide range of angle in order to acquire necessary radio waves from a plurality of satellites in the air for communication. FIG. 6 illustrates a radiation pattern of an ideal antenna gain. As shown in FIG. 6, it is desirable to have an antenna gain G1 in the vertical direction relative to the ground that is almost equal to an antenna gain G2 at a low elevation angle of about 60°. If such a uniform antenna gain is possible over a wide angle, antenna 31 can obtain an almost uniform antenna gain regardless of the location of a satellite 32 and in turn, perform high-quality communication via the satellite 32.

In addition to the helical antenna, conical, patch, and conical spiral antennas can be used since the satellite communication is normally performed using the circularly polarized waves. The conical spiral antenna is disclosed in a Japanese patent publication No. 5-251921 and the background information is inferred therefrom. The disclosed conical spiral antenna is made by etching a copper film on a dielectric circular cone to form a spiral coil. By doing so, it is possible to reduce the size of the antenna and increase the operating frequency band of the antenna. However, since the conical, patch and conical spiral antennas are expensive, a helical antenna with a short 4-line type helical antenna is widely used. Lately, an automobile equipped with the 4-line type helical antenna for a satellite telephone or satellite mobile telephone communication has come into wide public use. FIG. 7 illustrates an automobile mounted with the 4-line type helical antenna.

However, it is difficult for the 4-line type helical antenna to have a uniform gain or to increase the antenna gain at a low elevation angle, as compared with the other antennas. Therefore, when the satellite is positioned at a low elevation angle respect to the helical antenna, it is not possible for the satellite telephone attached to the vehicle to maintain or perform high-quality communication. Moreover, when the 4-line type helical antenna is attached to the chassis (or iron board) of the automobile, as shown in FIG. 7, the chassis functions as a ground plate for the antenna. That is, when the radio waves arrive at the antenna, an induced voltage occurs at the antenna in such a way that the re-radiation waves are radiated from the antenna. These re-radiation waves are flown on the chassis as a zero-phase-sequence current of the antenna current. As a result, the radiation pattern of the antenna unit or a vertical axial ratio of the radiation pattern may be distorted, thus making it difficult to obtain a uniform antenna gain over a wide angle and causes communication error.

SUMMARY OF THE INVENTION

It is, therefore, an object of the present invention to provide a 4-line type helical antenna with a simple structure to obtain a uniform antenna gain even at a low elevation angle, and exhibit a radiation pattern that is not affected even when the antenna is mounted on the chassis of an automobile.

To achieve the above and other objects, a helical antenna is provided for use in a satellite communication. The helical antenna includes a circular cone surface made of a metal interposed between an antenna body for transmitting and receiving radio waves to/from a satellite, and a satellite terminal for transmitting and receiving the radio waves to/from the antenna body, wherein the circular cone reflects the radio waves of the antenna body. By interposing the circular cone between the antenna body and the satellite terminal, it is possible to efficiently reflect the radio waves of the antenna body on the circular cone, thereby obtaining a uniform radiation pattern over a wide angle.

Preferably, the antenna body has antenna conductors that are spirally formed thereon, and the circular cone is tapered at a predetermined angle to uniformly reflect the radio waves of the antenna body. The circular cone is fixed to one end of the antenna body so that the tapered angle of the circular cone should be uniformly allocated with respect to the axis of the antenna body. By doing so, it is possible to obtain a uniform antenna gain even at a relatively low elevation angle.

Preferably, the tapered angle of the circular cone is determined in such a way that an antenna gain based on a radiation pattern of the antenna body should not become lower than a predetermined value even at an elevation angle of about 30° from the horizontal reference line. That is, by selecting an optimal tapered angle of the circular cone, the antenna gain is scarcely attenuated even at the low elevation angle of about 30° from the horizontal reference line. In this regard, if the tapered angle is preferably set to 30° with respect to the virtual axis of the circular cone, the antenna gain may not be attenuated below 5 dB.

Preferably, the tapered angle of the circular cone is determined in such a way that the radio waves of the antenna body should not be reflected on the ground when the helical antenna is attached to the ground. That is, the radio waves of the antenna body are effectively reflected by the circular cone tapered at a predetermined angle. Therefore, even when the helical antenna is mounted on the chassis of the automobile, the zero-phase-sequence current of the antenna radio waves flows on the chassis will have no effect, thus preventing the radiation pattern from being distorted. In addition, by determining a tapered angle for obtaining a desirable antenna gain, the antenna radio waves are simultaneously reflected to provide a solution for the ground reflection problem.

Preferably, the antenna body and the circular cone arc formed as one structure, and the tapered part of the circular cone is evaporated with a metal.

Preferably, the antenna conductor includes a patterned wired which is formed by etching, printing or firing on an isolation bar. By doing so, the productivity is further increased and the cost is reduced. In addition, by applying the inventive structure to a 4-line type helical antenna, it is possible to more efficiently maintain the antenna gain and provide a solution for the ground reflection problem.

BRIEF DESCRIPTION OF THE DRAWINGS

The above and other objects, features, and advantages of the present invention will become more apparent from the following detailed description when taken in conjunction with the accompanying drawings in which.

DETAILED DESCRIPTION OF THE PREFERRED EMBODIMENT

A 4-line type helical antenna according to a preferred embodiment of the present invention will be described herein below with reference to the accompanying drawings. For the purpose of clarity, well-known functions or constructions are not described in detail as they would obscure the invention in unnecessary detail.

Figure 2:
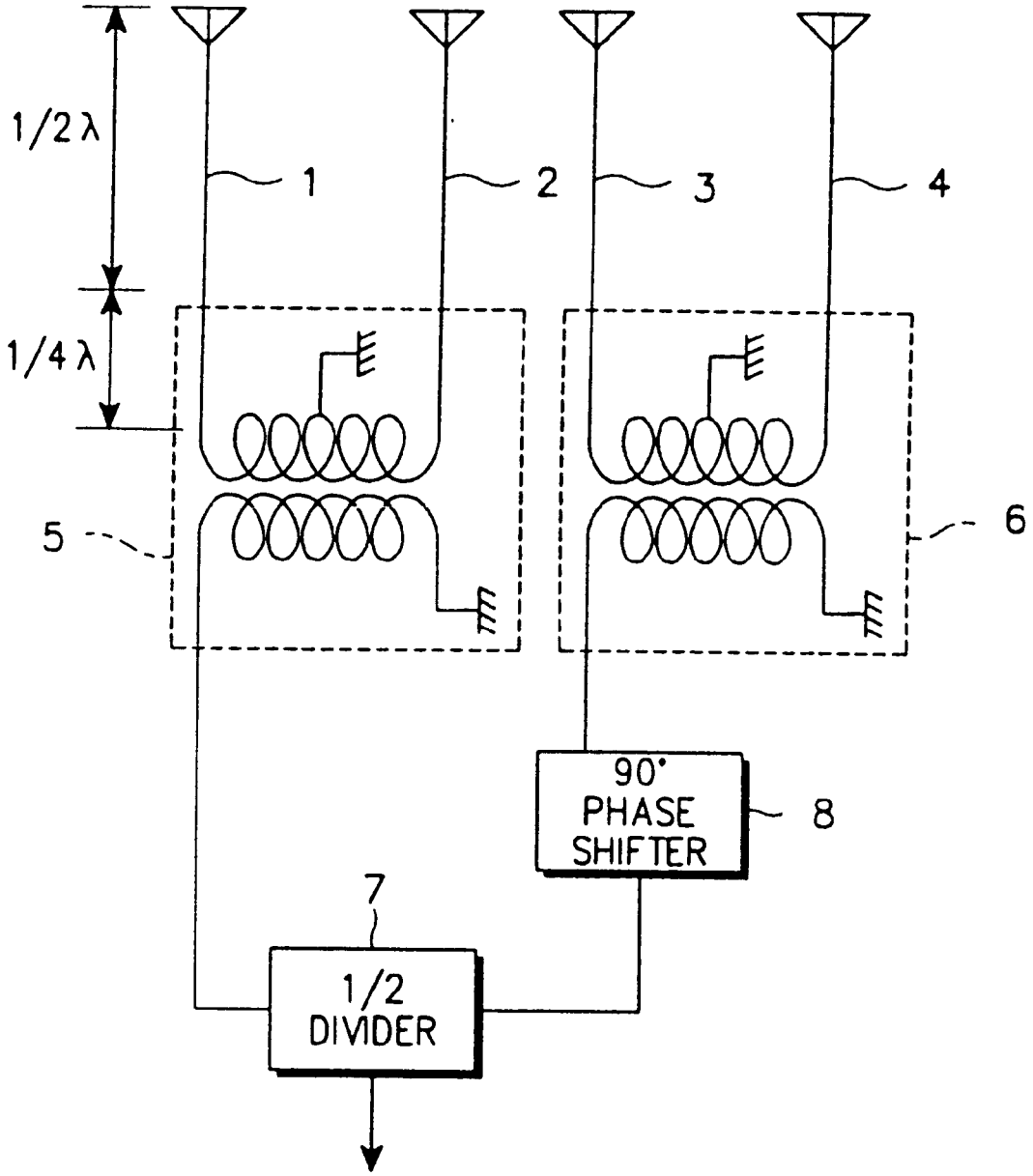
(PRIOR ART) FIG. 2
FIG. 2 is a circuit diagram of a general 4-line type helical antenna.

First, a brief description will be made of a 4-line type helical antenna. In FIG. 2, a circuit diagram of a general 4-line type helical antenna is illustrated. The 4-line type helical antenna includes 4 antenna elements 1 to 4, each having a 90° spatial phase difference; balance circuits 5 and 6 for matching the impedance of the antenna elements 1 to 4; a ½ divider 7 for distributing a signal to one pair of the antenna elements 1 and 2 and another pair of the antenna elements 3 and 4; and, a 90° phase shifter for shifting the phase of the antenna by 90°. The ½ divider 7 is connected to a terminal, such as the satellite telephone. Furthermore, the antenna elements 1 to 4 each have a length of $(\lambda/2)+(\lambda/4)$, where $\lambda$ represents a wavelength of the transmission and reception radio waves. Since the operation of the 4-line type helical antenna is well known in the art, a detailed description will be avoided herein.

FIG. 1A illustrates a side view of a 4-line type helical antenna attached to a beam forming cylinder according to the embodiment of the present invention, and FIG. 1B illustrates a bottom view of the 4-line type helical antenna of FIG. 1A.

FIG. 1A shows a state where the 4 antenna elements 1 to 4 of FIG. 2 are spirally wound to form a 4-line type helical antenna. Since the other parts of FIG. 2 are not directly related to the present invention, those are not illustrated in FIG. 1A.

Referring to FIG. 1A, an antenna section 11 is formed by spirally etching 4 helical elements 13 on a dielectric (e.g., plastic) cylinder 12. In the exemplary embodiment of the present invention, the 4 antenna elements 1 to 4 of FIG. 2, each having a length of $(\lambda/2)+(\lambda/4)$, are formed on the surface of the antenna section 11 in a spirally etched pattern. In the embodiment of the present invention, the antenna section 11 has a length of $0.59\lambda$ and a diameter of $0.093\lambda$. It should be noted that the method for forming the helical elements 13 is not restricted to the above described method. For example, the helical elements 13 may have a structure formed by the printing or the firing method, or may be a structure formed by winding a conducting wire or a structure with a spiral conductive layer included in a molded resin.

A conical beam forming cylinder 14 is formed at the bottom of the antenna section 11. Here, the beam forming cylinder 14 is provided to reflect the antenna radio waves. The beam forming cylinder 14 can be formed with a metal. Alternatively, the beam forming cylinder 14 may be formed with resin or ceramic, the surface of which is evaporated with the metal. In this embodiment, a resin pipe 15 for drawing a coaxial cable extracted from the antenna section 11 is unified with the beam forming cylinder 14, and a metal is evaporated on the surface of the conical beam forming cylinder 14.

The beam forming cylinder 14 is a hollow circular cone which is tapered at ±30° with respect to a virtual central vertical line, and has a height of over $0.3\lambda$ from its virtual top. A bottom surface of the beam forming cylinder 14 is constructed in such a way that it can be readily attached to the satellite telephone or the chassis of an automobile so as to connect a coaxial cable detached from the central pipe 15 of the antenna to the terminal. Furthermore, in the embodiment of the present invention, the balance circuit and various connecting elements are disposed in the hollow-beam forming cylinder 14, thereby contributing to efficient utilization of the space.

In the 4-line type helical antenna attached to the beam forming cylinder 14, the antenna current is reflected on the conical surface of the beam forming cylinder 14, so that it is possible to obtain the almost uniform antenna gain even at ±60° with respect to the vertical. That is, it is possible to obtain almost a uniform antenna gain over 120° with respect to the vertical, i.e., even at angles of 60° and 300° with respect to the vertical reference line (or, even at a low elevation angle of 30° with respect to the horizontal reference line). Therefore, when the 4-line type helical antenna attached of the beam forming cylinder is used for the satellite telephone, the radiation directivity of the transmission and reception radio waves is improved even at a low elevation angle, thereby securing the high-quality communication.

Figure 3:
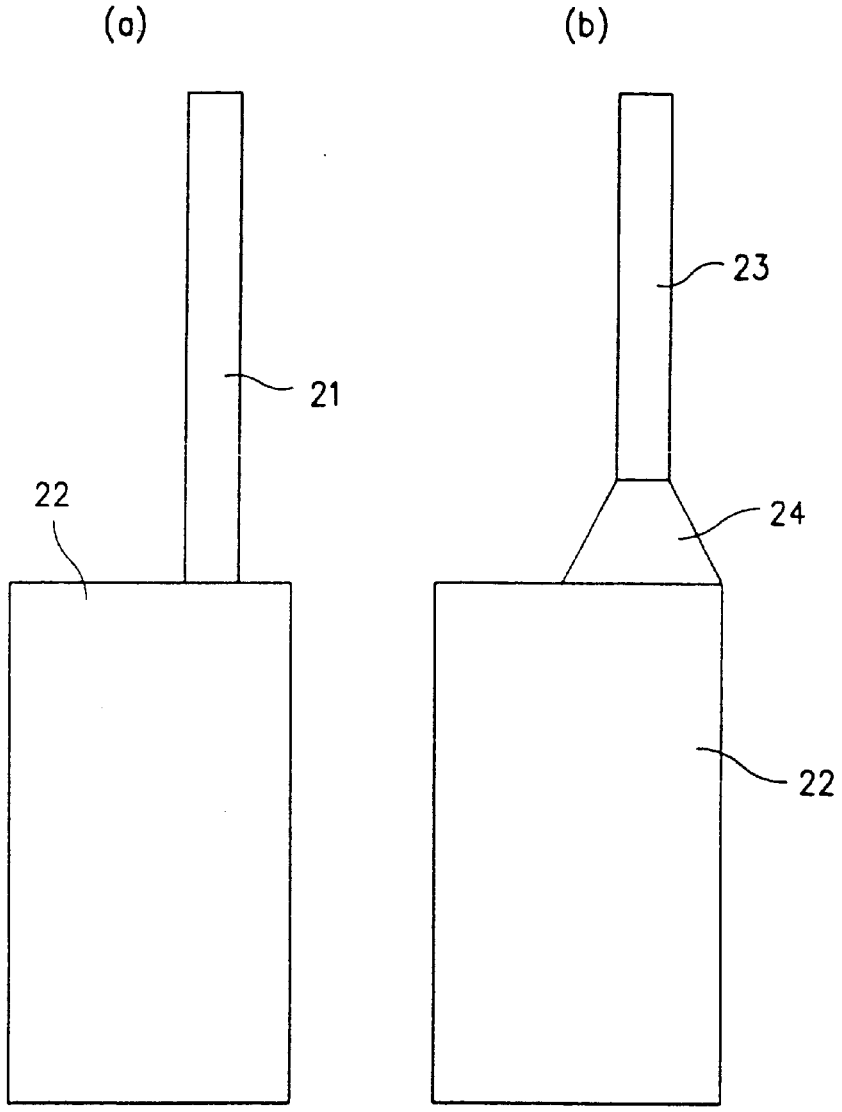
FIG. 3A is a diagram illustrating a satellite telephone mounted with a conventional 4-line type helical antenna.
FIG. 3B is a diagram illustrating a satellite telephone mounted with a 4-line type helical antenna attached to a beam forming cylinder according to the embodiment of the present invention.

FIG. 3A illustrates a satellite telephone mounted with the conventional 4-line type helical antenna, and FIG. 3B illustrates a satellite telephone mounted with the 4-line type helical antenna attached to the beam forming cylinder according to the embodiment of the present invention. In the case where a conventional 4-line type helical antenna 21 is mounted on a satellite telephone 22, as shown in FIG. 3A, the antenna gain is decreased by several dBs at a low elevation angle of about 30° with respect to the horizontal reference line (see FIG. 4). However, in the case where a 4-line type helical antenna 23 attached to the beam forming cylinder according to the present invention is mounted on the satellite telephone 22, as shown in FIG. 3B, the antenna gain is scarcely attenuated even at the low elevation angle of about 30° with respect to the horizontal line due to the antenna radio wave reflecting action of the beam forming cylinder 24 (see FIG. 5).

Figure 7:
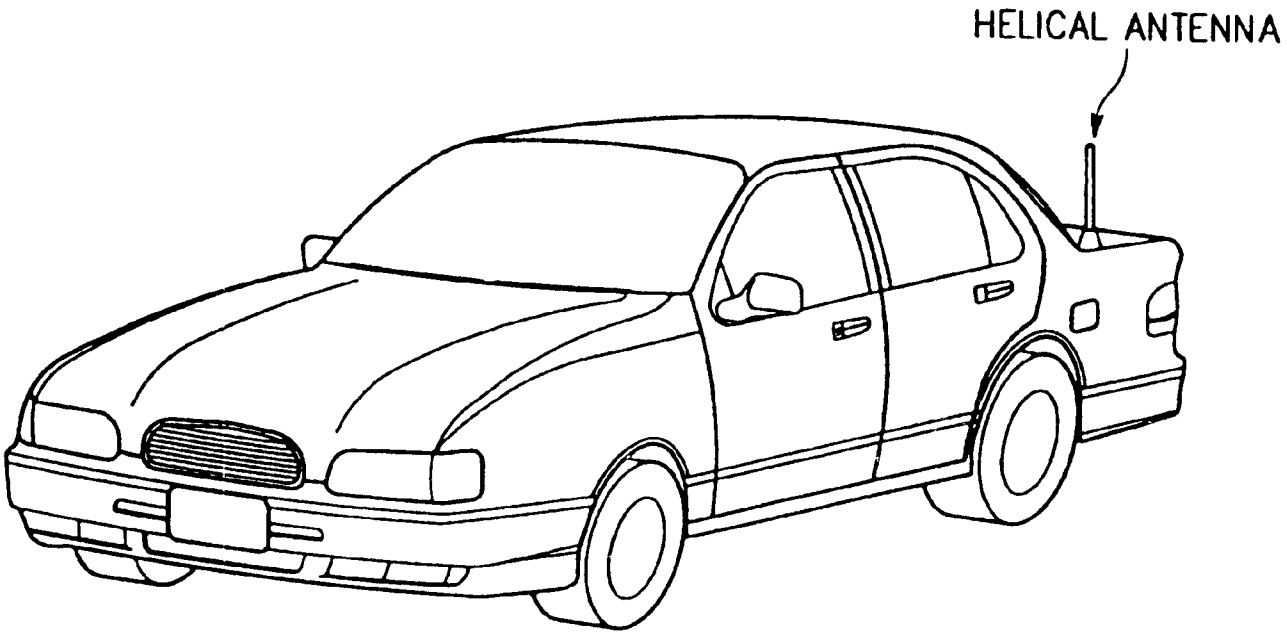

Moreover, in the case where the 4-line type helical antenna attached to the beam forming cylinder is mounted on the chassis of the automobile, as shown in FIG. 7, the helical antenna maintains a uniform antenna gain even at a low elevation angle and the antenna radio waves are reflected on the beam forming cylinder. Therefore, the zero-phase-sequence waves flow on the chassis of the automobile, thereby preventing radio interference.

Figure 1:
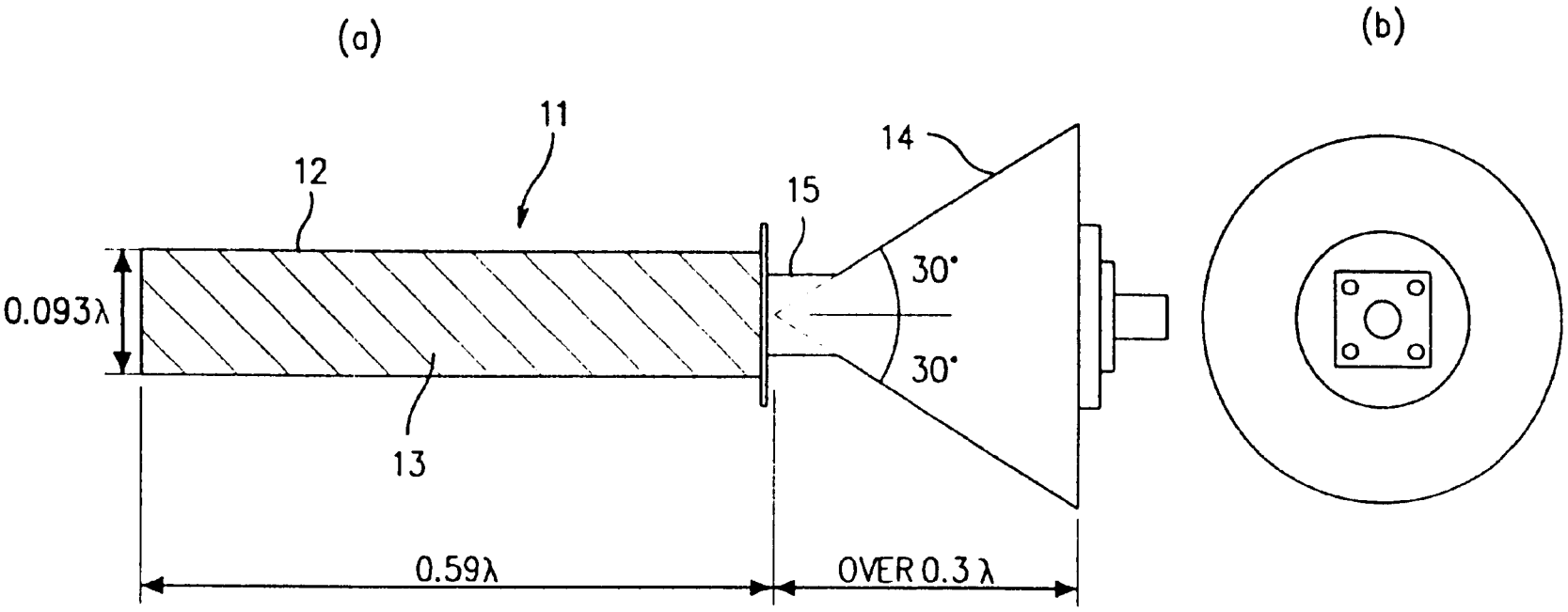
FIG. 1A is a side view of a 4-line type helical antenna attached to a beam forming cylinder according to the embodiment of the present invention.
FIG. 1B is a bottom view of the 4-line type helical antenna shown in FIG. 1A.
Figure 4:
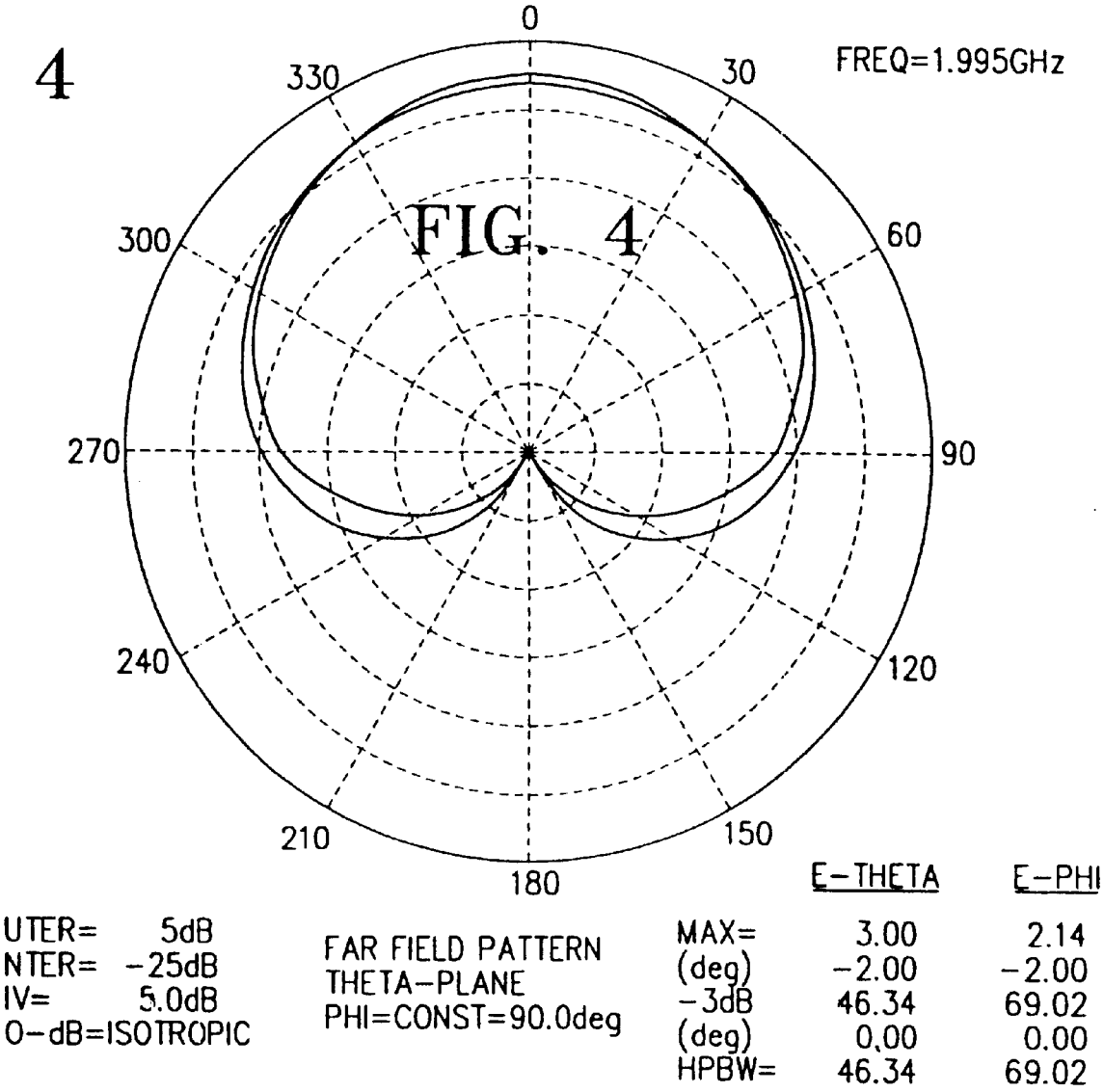
FIG. 4 is a diagram illustrating antenna gain data measured on the radiation pattern of the conventional 4-line type helical antenna.
Figure 5:
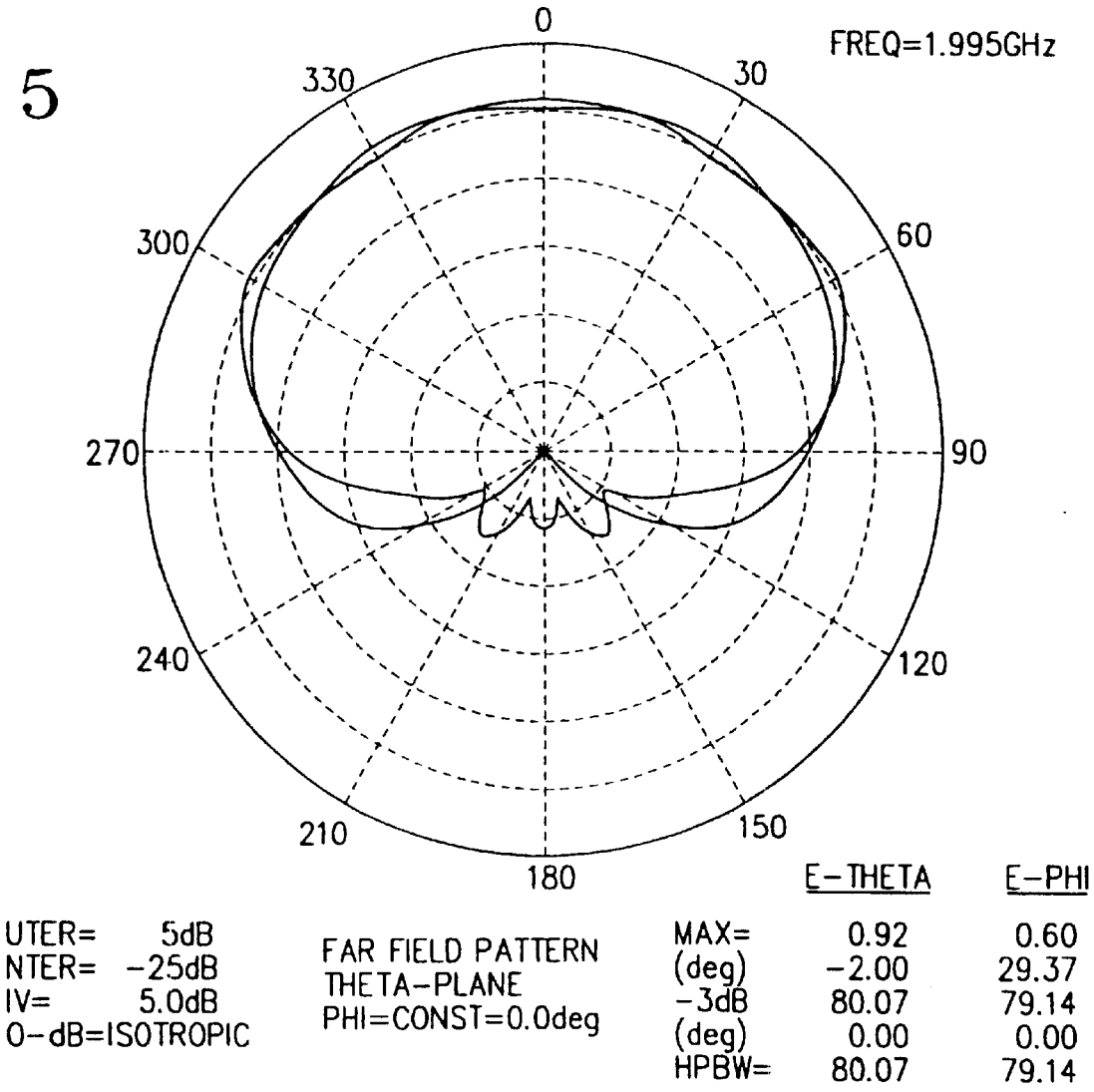
FIG. 5 is a diagram illustrating antenna gain data measured on the radiation pattern of the 4-line type helical antenna attached to the beam forming cylinder according to the embodiment of the present invention.
Figure 6:
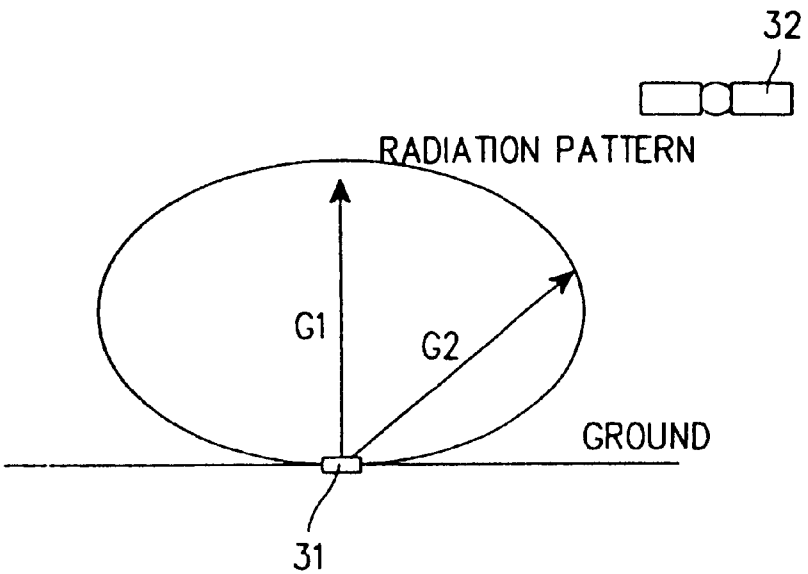
FIG. 6 is a diagram illustrating the radiation pattern of antenna gains; and, FIG. 7 is a diagram illustrating an automobile mounted with a 4-line type helical antenna.

Next, reference will be made to the antenna gains, measured through experiments, of the 4-line type helical antenna attached to the beam forming cylinder of FIG. 1. The measured radio waves have a frequency of 1.995 GHz and a wavelength of $\lambda$=150 nm. FIG. 4 illustrates antenna gain data measured on a radiation pattern of the conventional 4-line type helical antenna, and FIG. 5 illustrates antenna gain data measured on a radiation pattern of the 4-line type helical antenna attached to the beam forming cylinder according to the embodiment of the present invention. In FIGS. 4 and 5, the concentric circles represent scales (or graduations) indicating the antenna gain (dB) in both the vertical and horizontal polarized plane wave, wherein one scale indicates 5 dBs and the inter circles have the greater attenuation.

In addition, with regard to angles of the concentric circles, the vertical position is 0° and one scale is 30°. Therefore, 90° and 270° define the horizontal reference line. Reference will now be made to an antenna gain over an angle 120° between 60° and 300° (i.e., over an elevation angle of 30° from the horizontal). Here, it was measured whether the antenna gain at an angle 60° from the vertical (i.e., at an elevation angle 30° from the horizontal) is lower than 5 dB.

Two types of the measured data are shown. This is because the polarized waves of the two pairs of the antenna elements shown in FIG. 1A are measured before synthesizing. Since the terminal synthesizes the polarized waves, the terminal determines the antenna gain by reading an average value of the two data values.

In the conventional 4-line type helical antenna of FIG. 4, the antenna gain is attenuated by 2 dB with respect to the 5 dB scale at the angles of 60° and 300°. Therefore, when the satellite is located at an angle of about 60°, the communication quality is deteriorated. However, in the novel 4-line type helical antenna attached to the beam forming cylinder of FIG. 5, the antenna gain maintains the 5 dB scale at the angles of 60° and 300°. Therefore, the almost uniform antenna gain is maintained over the wide angle of 120°. Thus, a high-quality satellite communication can be performed even at the low elevation angle of 30° from the horizontal.

As described above, the 4-line type helical antenna attached to the beam forming cylinder according to the present invention can obtain a given radiation pattern even at the low elevation angle of 30° from the horizontal, and it can maintain the uniform antenna gain. Therefore, when used for the satellite telephone, the novel 4-line type helical antenna according to the embodiment of the present invention can perform high-quality communication even when the satellite is located at a low elevation angle. Furthermore, when the novel helical antenna is mounted on the chassis of the automobile, it is possible to obtain the desired radiation pattern and prevent the ground effect caused by the chassis of the automobile, thereby preventing a possible communication error.

While the invention has been shown and described with reference to a certain preferred embodiment thereof, it will be understood by those skilled in the art that various changes in form and details may be made therein without departing from the spirit and the scope of the invention as defined by the appended claims. For example, although the invention has been described with reference to the 4-line type helical antenna, it is possible to obtain the same results even though the invention is applied to a helical antenna of the different type.

As described above, in the present 4-line type helical antenna attached to the beam forming cylinder, the beam forming cylinder tapered at a given angle effectively reflects the antenna radio waves. As a result, it is possible to obtain an ideal radiation pattern and the antenna gain is scarcely attenuated even at a low elevation angle of about 30° from the horizontal reference line. Therefore, by mounting the 4-line type helical antenna, which is relatively small in size, on the satellite telephone, it is possible to perform high-quality communication even when the satellite is located at the low elevation angle. In addition, in the case where the novel 4-line type helical antenna attached to the beam forming cylinder is mounted on the chassis of the automobile, the beam forming cylinder serves to reflect the antenna radio waves, preventing the zero-phase-sequence current of the antenna from flowing on the chassis of the automobile.

Furthermore, the inventive 4-line type helical antenna attached to the beam forming cylinder is constructed in such a way that the wind pressure resistance can be reduced when the automobile travels at a high speed. Therefore, it is possible to reduce the antenna's wind cutting sound during the high-speed traveling communication. In addition, the device for attaching the antenna to the chassis of the automobile is simple and compact in size that it is possible to provide an economical antenna.

What is claimed is:

1. A helical antenna for use in communication with a satellite, comprising:

an antenna body for transmitting and receiving radio waves to/from said satellite;

a circular cone having a metal surface coupled to said antenna body; and, a satellite terminal for transmitting and receiving the radio waves to/from said antenna body, wherein said circular cone reflects the radio waves of said antenna body at a predetermined angle relative to the antenna body, wherein said predetermined angle of the radio wave transmission does not reflect off the ground when said helical antenna is attached to the ground.

2. The helical antenna as claimed in claim 1, wherein said antenna body includes antenna conductors which are spirally formed thereon and said circular cone is tapered at the predetermined angle so as to uniformly reflect the radio waves of said antenna body, and wherein said circular cone being fixed to one end of said antenna body so that the tapered angle of said circular cone is uniformly allocated with respect to an axis of said antenna body.

3. The helical antenna as claimed in claim 2, wherein the tapered angle of said circular cone is determined so that an antenna gain based on a radiation pattern of said antenna body is not lower than a predetermined threshold value even at an elevation angle of about 30° from a horizontal reference line.

4. The helical antenna as claimed in claim 3, wherein said antenna body and said circular cone are formed as one structure, and wherein the tapered surface said circular cone is evaporated with a metal.

5. The helical antenna as claimed in claim 4, wherein said helical antenna comprises a 4-line type helical antenna.

6. The helical antenna as claimed in claim 3, wherein said antenna body and said circular cone are formed as one structure, and wherein the tapered surface said circular cone is evaporated with a metal.

7. The helical antenna as claimed in claim 6, wherein said helical antenna comprises a 4-line type helical antenna.

8. The helical antenna as claimed in claim 3, wherein said antenna conductor includes a patterned wired which is formed by etching, printing, or firing on an isolation bar.

9. The helical antenna as claimed in claim 3, wherein said antenna conductor includes a patterned wired which is formed by etching, printing, or firing on an isolation bar.

10. The helical antenna as claimed in claim 3, wherein said helical antenna comprises a 4-line type helical antenna.

11. The helical antenna as claimed in claim 3, wherein said helical antenna comprises a 4-line type helical antenna.

12. The helical antenna as claimed in any one of claims 2, wherein said antenna body and said circular cone are formed as one structure, and wherein the tapered surface said circular cone is evaporated with a metal.

13. The helical antenna as claimed in claim 12, wherein said antenna conductor includes a patterned wired which is formed by etching, printing, or firing on an isolation bar.

14. The helical antenna as claimed in claim 12, wherein said helical antenna comprises a 4-line type helical antenna.

15. The helical antenna as claimed in claim 2, wherein said antenna conductor includes a patterned wired which is formed by etching, printing, or firing on an isolation bar.

16. The helical antenna as claimed in claim 2, wherein said helical antenna comprises a 4-line type helical antenna.

17. The helical antenna as claimed in claim 1, wherein said helical antenna comprises a 4-line type helical antenna.

* * * * *